United States Patent [19]

Boutin et al.

[11] Patent Number: 4,816,088

[45] Date of Patent: Mar. 28, 1989

[54] METHOD OF RAISING THE RECRYSTALLIZATION TEMPERATURE OF ALUMINIUM AND OF ITS ALLOYS

[75] Inventors: Francois-Régis Boutin, Virieu-sur-Bourbre; Guy-Michel Raynaud, Saint Egrève, both of France

[73] Assignee: Cegedur Societe de Transformation de L'Aliminium Pechiney, Paris, France

[21] Appl. No.: 124,281

[22] Filed: Nov. 23, 1987

[30] Foreign Application Priority Data

Dec. 2, 1986 [FR] France ..... 86 17015

[51] Int. Cl.[4] ..... C22F 1/04; C22C 21/00

[52] U.S. Cl. ..... 148/11.5 A; 148/401; 148/437; 420/7; 420/528

[58] Field of Search ..... 148/401, 437, 438, 439, 148/440, 2, 3, 11.5 A; 420/7, 528

[56] References Cited

U.S. PATENT DOCUMENTS 1,415,733 5/1922 Thofehrn ..... 148/401

3,104,252 9/1963 Radd et al. ..... 420/528

*Primary Examiner*—L. Dewayne Rutledge

*Assistant Examiner*—Robert L. McDowell

*Attorney, Agent, or Firm*—Dennison, Meserole, Pollack & Scheiner

[57] ABSTRACT

The invention relates to a method for the deformational transformation of aluminum and its alloys comprising the steps of deforming the aluminum in the solid state and annealing the deformed aluminum at a temperature at which recrystallization occurs. The recrystallization temperature of the aluminum is raised and the grain size is minimized by adding to the aluminim 5 to 1000 ppm uranium prior to the deformation. The method is particularly applicable to the production of aluminum based sheets intended to be subjected to heating at a relatively high temperature, for example the heating which accompanies enamelling or brazing operations, where the heating operation could change the mechanical properties of the sheets.

7 Claims, 6 Drawing Sheets

Without Addition (control)

20 ppm 50 ppm 100 ppm 200 ppm 500 ppm 1000 ppm

Without Addition (control)

20 ppm 50 ppm 100 ppm 200 ppm 500 ppm 1000 ppm

Without Addition (control)

20 ppm 50 ppm 100 ppm 200 ppm 500 ppm 1000 ppm

METHOD OF RAISING THE RECRYSTALLIZATION TEMPERATURE OF ALUMINIUM AND OF ITS ALLOYS

The invention relates to a method whereby it is possible to raise the recrystallisation temperature of aluminium and its alloys and to minimise the grain size.

It is a known fact that in dimensional transformations of a metal in the solid state, such as rolling, for example, a phenomenon occurs which is termed hammer-hardening, that is to say the crystalline structure of the metal is altered: faults, dislocations and cells of hammer-hardening appear.

If this metal is annealed, it develops towards a more stable condition of equilibrium which depends upon the temperature and length of the annealing process.

For example, in a first so-called restoration stage, a restructuring of the metal takes place which tends to organise linear defects in a polygonised wall. Then, in a stage referred to as primary recrystallisation, almost perfect grains appear in certain regions and develop until they come in contact with one another. Finally, the number of grains diminishes to bring about the most stable recrystallised structure which corresponds to a minimal surface area of grain joints.

It is likewise well-known that the addition of certain elements to alloys during their processing or even the presence of certain impurities can have an effect of slowing down this evolution, that is to say the temperature at which primary recrystallisation starts is then higher and that for a given temperature the size of the grains formed is smaller. For instance, numerous authors have reported the delaying effect of zirconium for concentrations of around 2000 ppm when it is precipitated finely into the sub-joints at the moment of annealing. The same goes for iron but at lower concentrations of around a few hundred ppm.

The Applicants have found that this slowing-down effect could also be obtained by the addition of uranium but entailing the use of far smaller quantities of this element than of zirconium and iron since the effect appeared when concentrations were as low as 5 ppm. Hence the method which is the object of the invention, which makes it possible to raise the recrystallisation temperature of aluminium and its alloys and minimise the grain size, being characterised in that between 5 and 1000 ppm of uranium are added at the moment of processing.

The slowing-down effect increases with the uranium concentration but reaches a maximum of about 200 ppm.

The existence of a limitation on the efficacy of the retarding influence for strong concentrations of uranium seems due to the fact that only the uranium which is in solid solution prior to the annealing has any effect.

This is confirmed by experiments which have shown that to obtain a similar effect it required less uranium when the metal is subjected to an homogenisation operation following casting, at an elevated temperature instead of a simple reheating at a lower temperature. For practical purposes, the optimum concentration is around 50 ppm in the first case and 150 ppm in the second.

The Applicants have likewise found that in the case of a simple reheating, the more iron contained in the metal, the more it was possible to reduce the quantity of uranium and still obtain a similar effect.

Therefore, there is a combined effect of these two elements which makes it possible, according to the greater or lesser purity of iron in the metal used, to supplement the effect of this element by a small quantity of uranium.

To this retarding effect of the uranium must likewise be added the other effect which, if one nevertheless exceeds the recrystallisation temperature, is that of minimising the size of the grains.

BRIEF DESCRIPTION OF THE DRAWINGS

The invention may be illustrated with the help of FIGS. 1 to 21 which represent photographs of granular structures of a plurality of aluminium alloys which have been doped with various quantities or uranium and subjected to particular annealing conditions.

As it happens, there are three aluminium alloys of type 1085 complying with the standards of the Aluminium Association and having the following composition:

Figure 1:
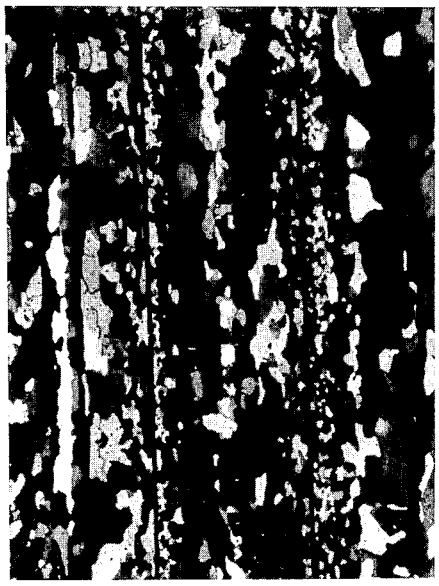

| | Content of impurities in ppm | | | | | | | | | | | |
|---|---|---|---|---|---|---|---|---|---|---|---|---|
| REF | Si | Fe | Cu | Mn | Mg | Cr | Ni | Zn | Ti | V | B | Ga |
| A | 200 | 630 | <20 | <20 | <10 | <10 | 180 | 90 | 300 | 50 | 17 | 80 |
| B | 200 | 630 | <20 | <20 | <10 | <10 | 210 | 90 | 280 | 40 | 12 | 80 |
| C | 260 | 700 | <20 | <20 | <10 | <10 | 170 | 80 | 260 | 50 | 13 | 90 |

Starting from each of these, a series of seven ingots were prepared and given references 1 to 7 for the alloy A, 8 to 14 for alloy B and 14 to 21 for alloy C, the alloys being such that in each series the uranium contents are respectively 0, 20, 50, 100, 200, 500 and 1000 ppm. The ingots are then subjected to the following changes:

ingots 1 to 7 were homogenised for 60 hours at 620° C., then quenched in water, cold rolled to a thickness of 0.45 mm, the resultant sheet being annealed for 1 hour at 350° C.;

ingots 8 to 21 were reheated to 465° C. and maintained at this temperature for 5 hours, then naturally cooled, cold rolled down to a thickness of 0.45 mm, the resultant sheet being annealed for 30 minutes at 310° C.

Figure 2:
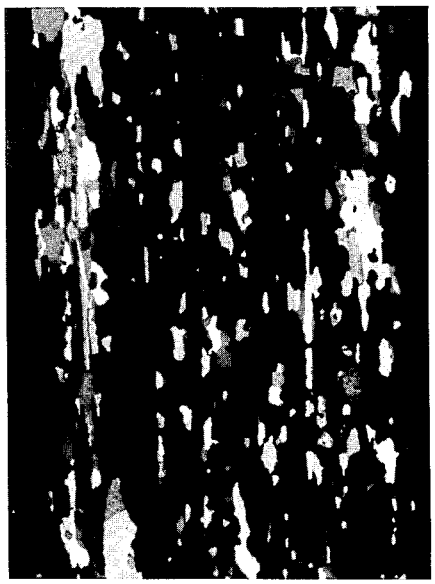
Figure 3:
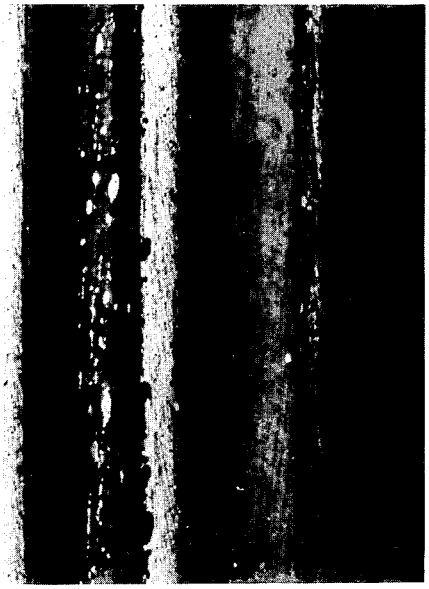
Figure 4:
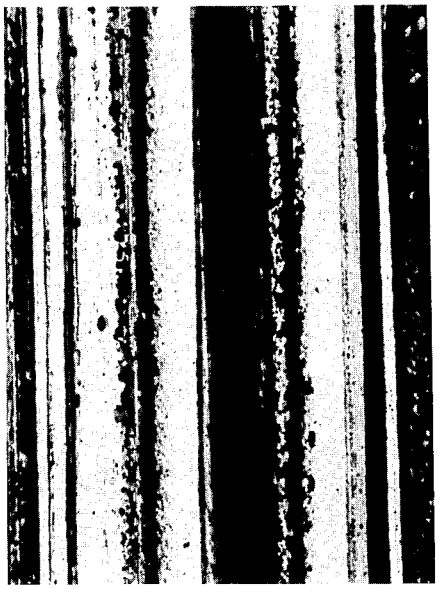
Figure 5:
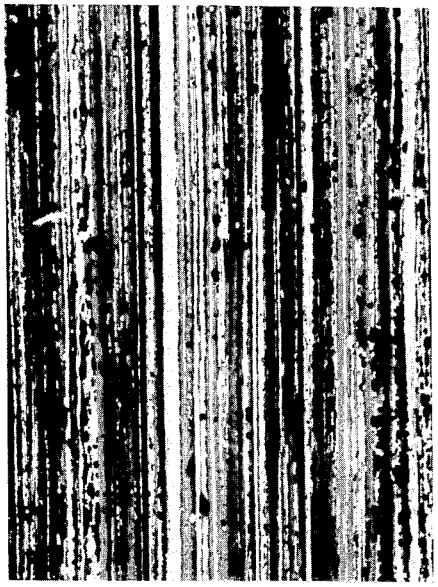
Figure 6:
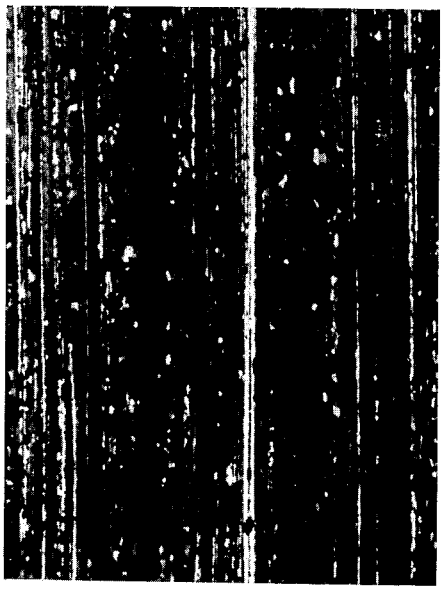
Figure 7:
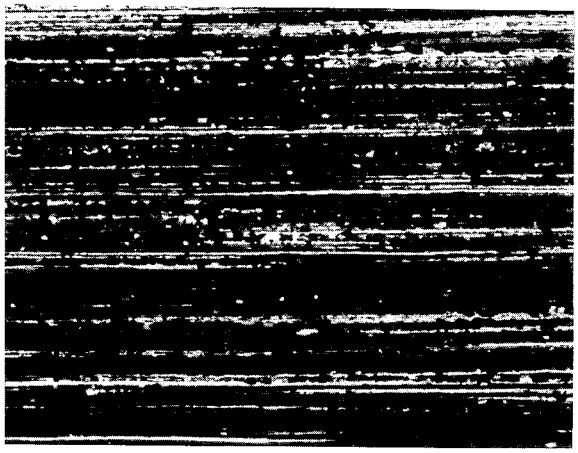
Figure 8:
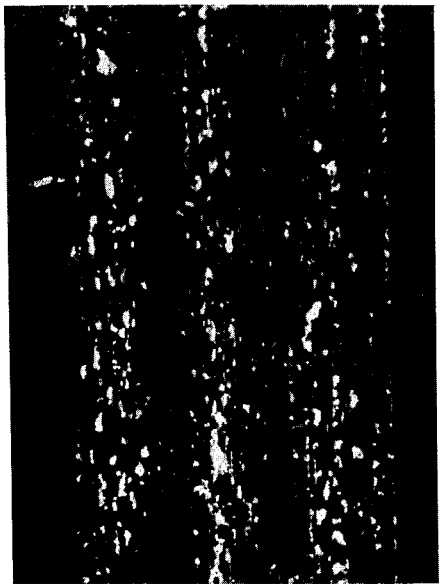
Figure 9:
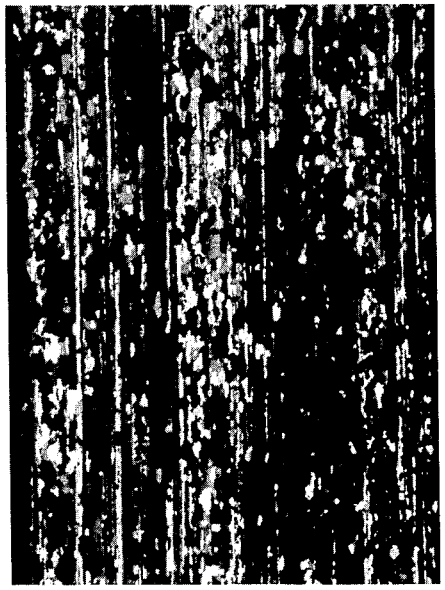
Figure 10:
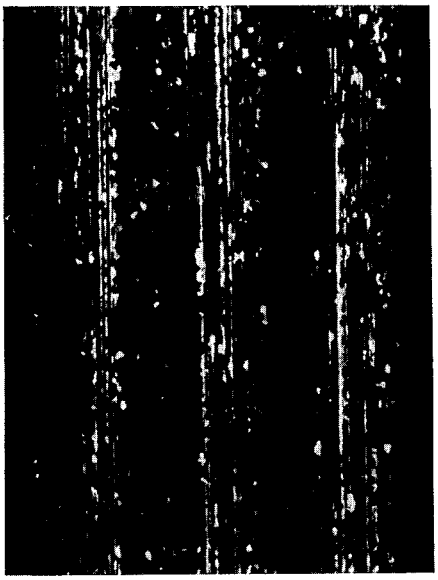
Figure 11:
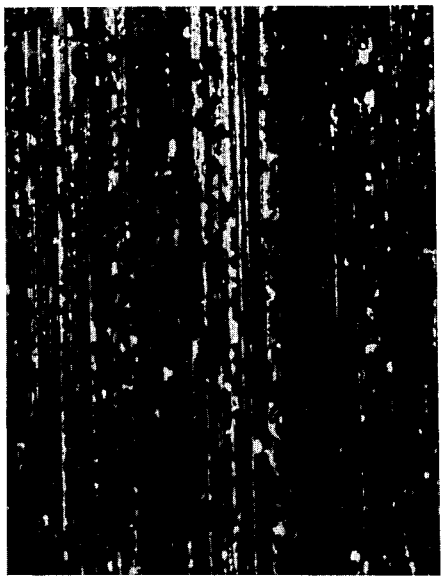
Figure 12:
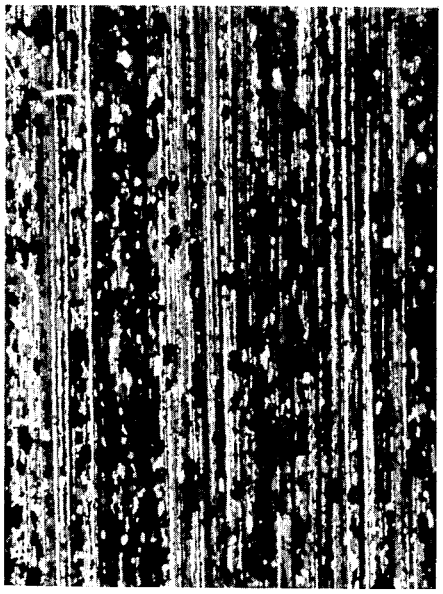
Figure 13:
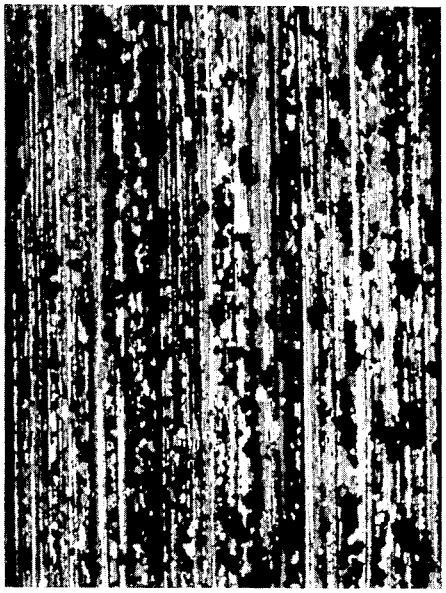
Figure 14:
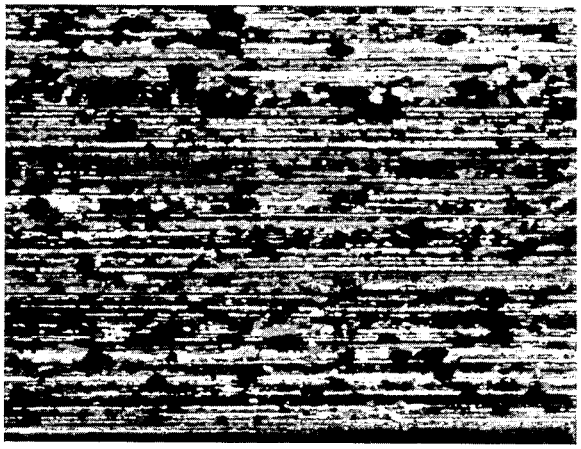
Figure 15:
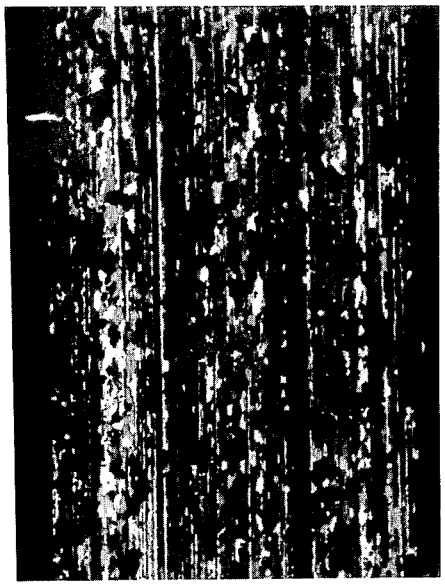
Figure 16:
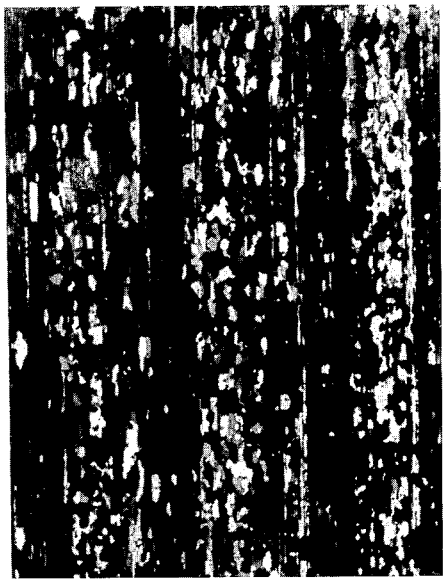
Figure 17:
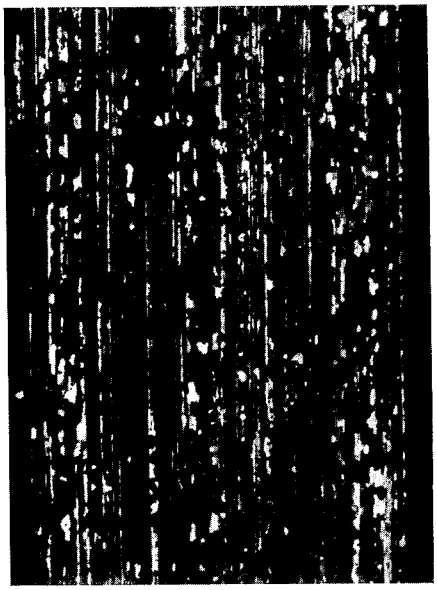
Figure 18:
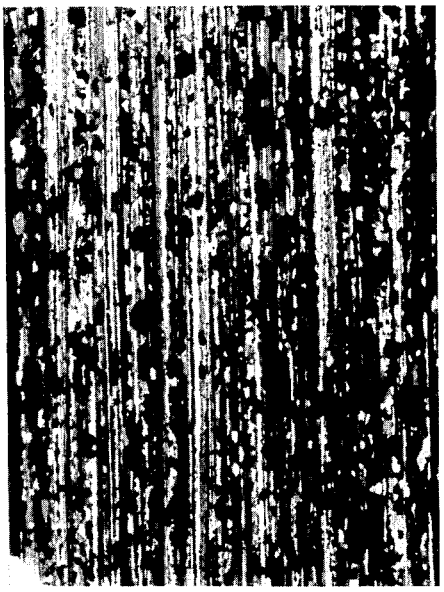
Figure 19:
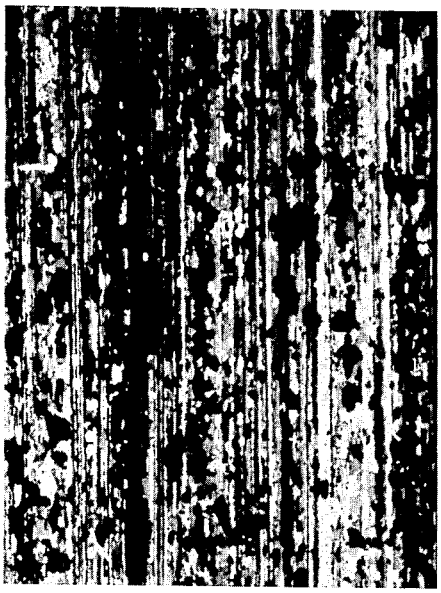
Figure 20:
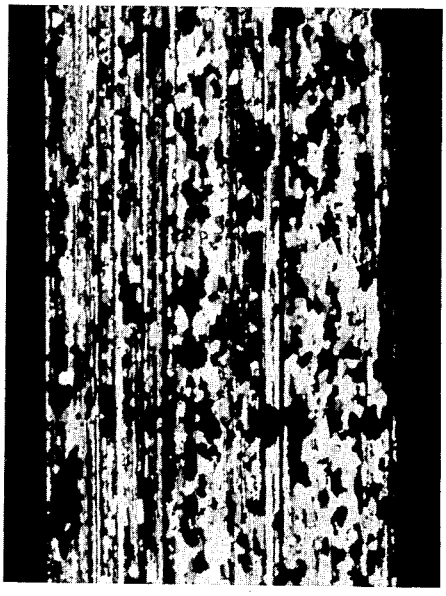
Figure 21:
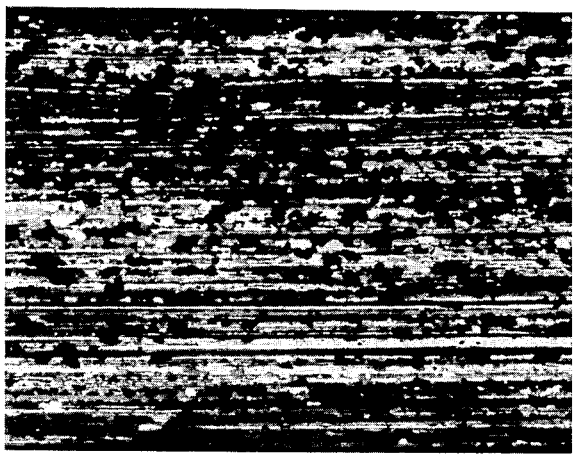

The granular structures observed on the annealed plates obtained from the 21 ingots are shown in FIGS. 1 to 21 corresponding to the references of the ingots.

They make it possible to show that the following results of crystallisation are obtained:

| | Ref. | | |
|---|---|---|---|
| Content in U (ppm) | A (homogenised) | B (reheated) | C (reheated) |
| 0 | E.R. grain size heterogeneous | fr = 95% | fr = 80% |
| 20 | E.R. grains finer and more homogeneous | fr = 80% grains coarse | fr = 80% |
| 50 | fr < 10% a few grains near the edge | fr = 50% N.R. thoroughly | fr = 40% grains coarse |
| 100 | fr = 15% coarse lining | fr = 50% N.R. thoroughly | fr = 40% grains coarse |

-continued

| Content in U (ppm) | Ref. A (homogenised) | B (reheated) | C (reheated) |
|---|---|---|---|
| 200 | fr = 15% fine lining | fr < 30% | fr = 40% grains coarse |
| 500 | fr = 20% very fine lining | fr < 30% | fr = 40% grains coarse |
| 1000 | fr = 20% very fine lining | fr < 30% | fr = 40% finer grains |

E.R.: entirely recrystallised
N.R.: not recrystallised
fr: fraction recrystallised.

From this Table it can be deduced that:

the effect of the uranium on the rate of recrystallisation is quite substantial as from 50 ppm, the effect is quite considerable in the case of homogenisation. When the metal is only reheated, it requires more uranium to achieve a similar effect, in the case of the reheated metal, the higher the iron content of the metal the more pronounced is the effect of the uranium (comparison of content reference C<-content ref. B), the effect of the uranium shows no further increase beyond 200 ppm.

Consequently, the addition of uranium at contents comprised between 50 and 200 ppm has a retarding effect in an alloy of type 1085 and therefore and raises the recrystallisation temperature. The optimum concentration depends upon the range of transformation of the metal:

50 ppm approx. if the metal is homogenised 150 ppm approx. if it is reheated.

Furthermore, with effect from 200 ppm, the uranium diminishes considerably the enlargement of the grain particularly in the case of homogenised alloys at high temperature.

This invention is applied particularly to the production of aluminium based sheets intended to be subjected to heating at relatively high temperature such as, for example, that which accompanies enamelling or brazing operations, without this treatment possibly changing the mechanical properties of the said sheets.

What is claimed is:

1. In a method for the deformational transformation of aluminum and its alloys comprising the steps of deforming aluminum in the solid state and annealing the deformed aluminum at a temperature at which recrystallization occurs, the improvement comprising increasing the temperature of recrystallization of said aluminum by adding to said aluminum prior to said transformation 5 to 1000 ppm uranium.

2. Method according to claim 1, wherein between 50 and 150 ppm of uranium are added.

3. Method according to claim 1, comprising the step of homogenizing the aluminum and added uranium prior to deforming.

4. Method according to claim 3, wherein about 50 ppm uranium is added.

5. Method according to claim 1, comprising the step of reheating the aluminum and added uranium prior to deforming.

6. Method according to claim 5, wherein about 150 ppm uranium is added.

7. Method according to claim 5, wherein said aluminum contains iron, and 5 to less than about 150 ppm uranium is added.

* * * * *